US006716144B1

(12) United States Patent
Shifferaw

(10) Patent No.: US 6,716,144 B1
(45) Date of Patent: Apr. 6, 2004

(54) ABDOMINAL EXERCISE MACHINE

(76) Inventor: Tessema Dosho Shifferaw, 3000 Giant Rd., San Pablo, CA (US) 94806

( * ) Notice: Subject to any disclaimer, the term of this patent is extended or adjusted under 35 U.S.C. 154(b) by 0 days.

(21) Appl. No.: 09/539,682

(22) Filed: Mar. 30, 2000

Related U.S. Application Data

(60) Provisional application No. 60/185,081, filed on Feb. 25, 2000.

(51) Int. Cl.[7] ..... A63B 26/00; A63B 71/00

(52) U.S. Cl. ..... 482/140; 482/93; 482/121; 482/122; 482/123; 482/129; 297/161; 297/71

(58) Field of Search ..... 482/93, 123, 130, 482/140, 907, 908, 133, 142, 121, 122, 125–126, 129, 134; 297/161, 17, 25–26, 377, 378.1, 378.12, 354.12, 452.3; 5/607–609, 615, 634

(56) References Cited

U.S. PATENT DOCUMENTS

| | | | | |
|---|---|---|---|---|
| 1,215,609 A | | 2/1917 | Arnold | |
| 1,821,417 A | | 9/1931 | Bounds | |
| 3,497,216 A | * | 2/1970 | Feather | 272/83 |
| 3,497,217 A | * | 2/1970 | Feather | 272/83 |
| 4,287,620 A | | 9/1981 | Zur | |
| 5,352,173 A | | 10/1994 | McLaughlin | |
| 5,441,473 A | | 8/1995 | Safani | |
| 5,545,114 A | | 8/1996 | Gvoich | |
| 5,624,361 A | | 4/1997 | Lai | |
| 5,806,115 A | * | 9/1998 | Brown | 5/615 |
| 5,865,715 A | * | 2/1999 | Wallick | 482/124 |
| 5,897,470 A | * | 4/1999 | Chen | 482/123 |
| 5,931,769 A | | 8/1999 | Nunez | |
| 5,947,876 A | | 9/1999 | Willey, II | |

* cited by examiner

*Primary Examiner*—Nicholas D. Lucchesi
*Assistant Examiner*—L Amerson
(74) *Attorney, Agent, or Firm*—Edward S. Wright

(57) ABSTRACT

The present invention provides and exercise device and methods designed to assist the exerciser in all abdominal strengthening exercises by use of an adjustable resilient means to provide resistance and absorb impact for the exerciser's eccentric range of motion, while supporting or boosting exerciser's concentric range of motion. This device offers maximum support for the exerciser's hips and back through the full range of abdominal exercises. The device includes a seat member and back member pivotally connected so that the seat and back provide a horizontal platform for the exerciser's use in a full range of abdominal exercise. When the preferred embodiment is not in use, the back member and seat member fold together for ease of storage or portability. A second embodiment offers the advanced exerciser adjustable foot positioning and back member positioning and is supported by an external frame assembly. All embodiments of the device allow the exerciser to tailor each exercise workout to the desired repetition level and to combine aerobic as well as anaerobic conditioning, all based on the exerciser's relative level of fitness.

23 Claims, 4 Drawing Sheets

ABDOMINAL EXERCISE MACHINE

CROSS-REFERENCE TO RELATED APPLICATIONS

This application is based on Provisional Application No. 60/185,081, filed Feb. 25, 2000.

BACKGROUND OF THE INVENTION

The present invention generally relates to methods and apparatus for exercising the abdominal muscles. A variety of exercise equipment have been developed to exercise abdominal muscles. These devices range from adjustable inclined surfaces with foot stirrups for securing a user's feet in place while sit-ups are performed to equipment in which the user sits and moves forward against adjustable resistance. Another variation of this general abdominal equipment is a floor positioned curved rocker system for support of the reclined user's upper body. As the user performs regular sit-ups, the device rocks back and forth for the full range of exercise motion.

Information relevant to attempts to address these problems can be found in U.S. Pat. No. 5,441,473, issued Aug. 15, 1995, U.S. Pat. No. 5,545,114, issued Aug. 13, 1996, U.S. Pat. No. 5,897,470 issued Apr. 27, 1999, U.S. Pat. No. 5,931,769, issued Aug. 3, 1999, and U.S. Pat. No. 5,947,876, issued Sep. 7, 1999. However, each one of these references suffers from one or more of the following disadvantages: limited range of motion or breadth of exercise range; unwieldy size and lack of portability; lack of support assist to beginner exercisers; lack of impact adsorption at the full extension of exercise motion; lack of scalable adjustment to the support assist available to the exerciser, simplicity in use and instruction; lack of an aerobic exercise mode or component, and expense.

These various drawbacks can discourage beginners or non-athletic users from participating in a conditioning and strengthening regimen for abdominal exercise. When used without training or instruction, these apparatus can actually injure the user from strain or improper exercise motion. Many of these systems are too costly or unwieldily for home use or travel.

The most significant limitation of the prior-art devices is the failure to duplicate the range of motion necessary to condition the upper, lower, oblique or lateral abdominal muscles while assisting the novice or beginner user in offering scalable impact absorption at the full range of extension for any of the associated exercise positions. This limitation increases the likelihood of improper exercise form, injury, or discontinued use due to the lack of any tangible benefit from the exercise.

For the foregoing reasons there is need for an improved abdominal muscle exercise apparatus and methods which employ a means for impact absorption at the full extension range of abdominal exercise motion.

DISCLOSURE OF INVENTION

Apparatus and methods are provided for specifically strengthening and toning the abdominal muscles of a human exerciser. The apparatus includes a seat member and back member pivotally connected so as to allow use for a full range of abdominal exercises when the apparatus is in the horizontally open position, and easy storage or portability when the apparatus is vertically closed.

A primary benefit of the present invention is the fact that through a connected, adjustable resilient means the back member bounces to assist the exerciser in the upward or concentric motion, offering from twenty (20%) percent to forty (40%) percent of the force necessary to rise up, while assisting in ten (10%) percent to twenty (20%) of the exertion in the downward motion. This connected, adjustable resilient means likewise serves to cushion or absorb impact of the exerciser's downward or eccentric motion, the range of motion in which the abdominal muscles need the most assistance for the exercises available using the present invention. The exerciser needs not contact the back member at all time; only during the extended positions where the eccentric motion transfers to the concentric motion. Through the connected, adjustable resilient means, the back member pushes or propels the exerciser up to the full concentric position. The exerciser then can slowly reverse movement, using the abdominal muscles to control eccentric motion to a contact point of seat member thus engaging the connected, adjustable resilient means assistance. By setting the connected, adjustable resilient means to a desired preset, the exerciser can maximize the exercise regimen, thus working the abdominal muscles longer. Aerobic and anaerobic condition can be combined in a single series of exercises, depending on the exerciser's particular level of conditioning.

The seat member ergonomically shaped to support exerciser's buttocks and upper thighs. When the exerciser reverses alignment, the seat shape serves to fit the back and support the lumbar area. In one embodiment of the present invention the seat member is solidly supported by legs which retract into the underside of the seat member when the apparatus is not in use. The seat member also provides two solid handles extending outward for the sides. These handles retract within the seat member when the apparatus is not in use.

In a second embodiment of the present invention an external frame assembly supports a seat member and a back member. Said external frame is fixedly attached to said seat member, and adjustably attached to said back member. In this second embodiment of the present invention said external frame also provide an adjustable foot rest for the exerciser.

The back member is ergonomically fitted with a backboard designed to fit the back and support the lumbar area in all exercises. This backboard can be made from foam or similar polyurethane materials. When the exerciser reverses alignment, the back member supports the exerciser's buttocks and upper thighs. To allow the exerciser to utilize the full range of motion necessary for optimal abdominal exercise, the back member houses an adjustable resilient means which opposes force applied to the seat back. The adjustable resilient means is retractable into the back member when the apparatus is not in use.

In one method of operation, an exerciser sits on the seat member with the exerciser's back against the back member. With hands on the seat handles, the exerciser performs a variety of abdominal exercises by pushing back on the back member to the point of full extension, whereby the adjustable resilient means assists the exerciser in returning to the starting position of the exercise. This cycle is repeated for several repetitions depending on the exerciser's level of conditioning or the adjustment of the resilient means. During this operation, the exerciser may elect to keep the feet on the floor with the knees bent and raised above the torso, or the feet can be raised with the knees bent or straight, depending on the conditioning level of the user.

In a second method of operation, an exerciser sits on the back member with the exerciser's back against the seat members. By locking the arms under the seat handles, the exerciser performs a variety of abdominal exercises by pushing down on the back member with the legs at full lowered position, whereby the adjustable resilient means assists the exerciser in raising the legs to the starting position of the exercise. This cycle is repeated for several repetitions depending on the exerciser's level of conditioning or the adjustment of the adjustable resilient means.

The present invention thus provides an exerciser with a full complement of exercises for all abdominal areas. The apparatus is relatively inexpensive and it is lightweight for easy storage or portability when the apparatus is not in use. The resilient impact absorption provides the exerciser a scalable assistance at the full range of extension in the exercises, so as to minimize improper form or injury.

It is therefore an object of the present invention to provide a new exercise device apparatus and methods which have many of the advantages of the exercise devices mentioned heretofore and many novel features that result in a new exercise device which is not anticipated, rendered obvious, suggested, or even implied by any of the prior art exercise devises, either alone or in any combination thereof.

It is another object of the present invention to provide a new exercise device which may be easily and efficiently manufactured and marketed.

It is a further object of the present invention to provide a new exercise device which is of a durable and reliable construction.

An even further object of the present invention is to provide a new exercise device which is susceptible of low cost of manufacture with regard to both materials and labor, and which accordingly is then susceptible of low prices of sale to the consuming public, thereby making such exercise device economically available to the buying public.

Still yet another object of the present invention is to provide a new exercise device for exercising the abdominal and back muscles of a user.

These together with other objects of the invention, along with the various features of novelty which characterize the invention, are described with particularity in the claims attached to and forming a part of this disclosure. For a better understanding of the invention, its operating advantages and the specific objects attained by its uses, reference should be made to the attached drawings and descriptive materials in which there are illustrated preferred embodiments of the invention.

BEST MODE FOR CARRYING OUT THE INVENTION

FIGS. 1–4 show a presently preferred embodiment of the abdominal muscle exercise apparatus invention consisting essentially of a seat member 1 connected by a pivot 8 to a back member 2 which together support the exerciser in a range of exercise positions initiated from a supine position on the apparatus as more generally indicated by FIGS. 13–17.

Figure 5:
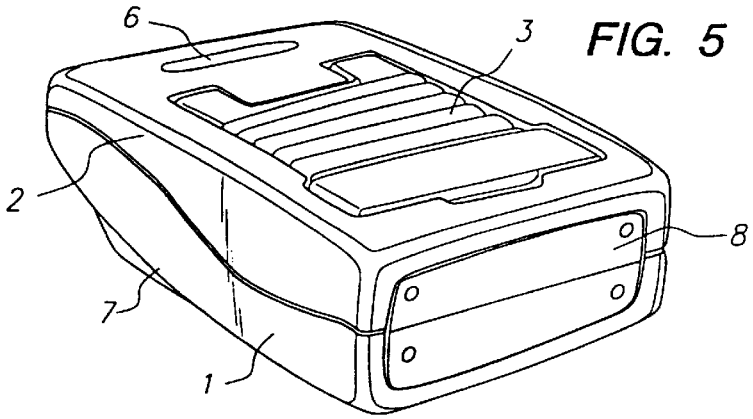
FIG. 5 is an isometric view of a third preferred embodiment of the abdominal muscle exercising device of the present invention folded closed with adjustable resilient means retracted for transport or storage.
Figure 6:
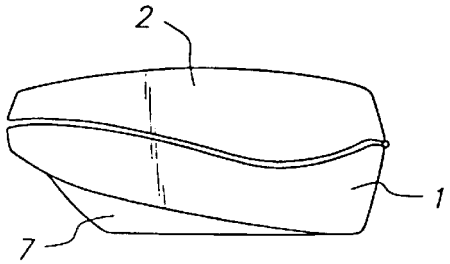
FIG. 6 is a side view of a third preferred embodiment of the abdominal muscle exercising device of the present invention folded closed with adjustable resilient means retracted for transport or storage.
Figure 7:
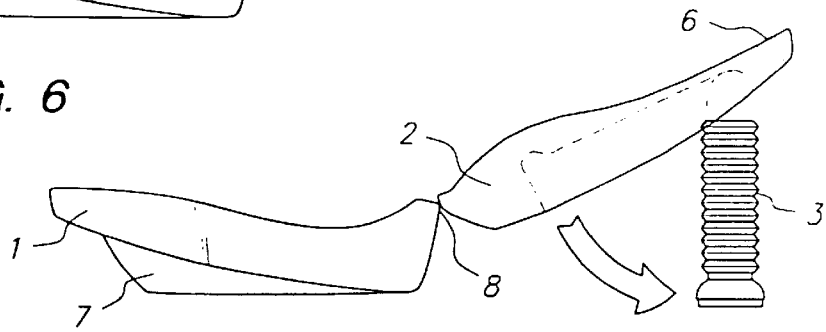
FIG. 7 is a side view of a third preferred embodiment of the abdominal muscle exercising device of the present invention with adjustable resilient means fully extended for use.

The seat member 1 bottom side contains retractable front and back support legs 5 and retractable seat handles 4. In a third presently preferred embodiment, the bottom side of the seat member is constructed of a unitary horizontal support structure 7 as depicted in FIGS. 5–7.

The seat member 1 top side is ergonomically fitted to receive the exerciser's buttocks and upper thighs as depicted in FIGS. 2 and 3, and 13–15.

Figure 1:
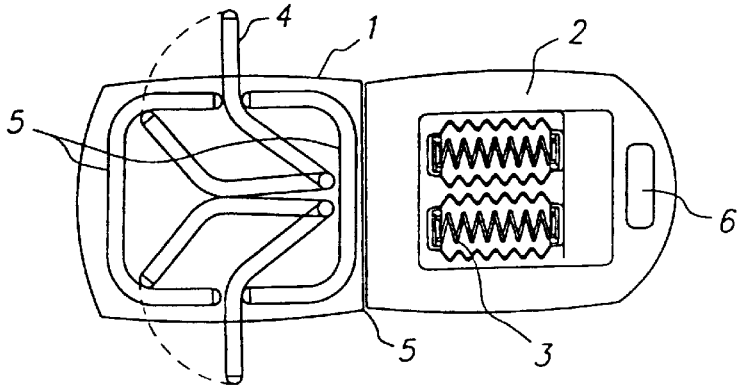
FIG. 1 is a bottom view of a presently preferred embodiment of the abdominal muscle exercising device of the present invention indicating the retractable legs and handle in the seat member and the retractable, adjustable resilient means in the back member.
Figure 2:
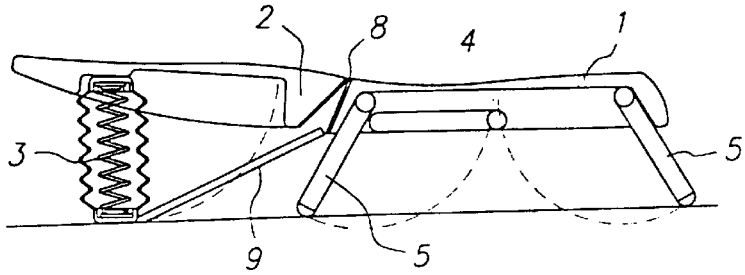
FIG. 2 is a side view of a presently preferred embodiment of the abdominal muscle exercising device of the present invention with adjustable resilient means, seat handles, and supporting legs fully extended for use.
Figure 3:
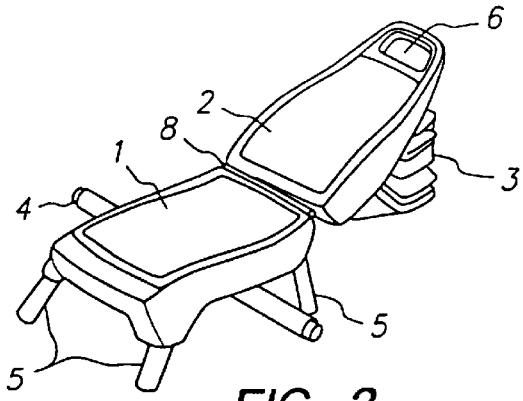
FIG. 3 is an isometric view of a presently preferred embodiment of the abdominal muscle exercising device of the present invention with adjustable resilient means, seat handles, and supporting legs fully extended for use.
Figure 4:
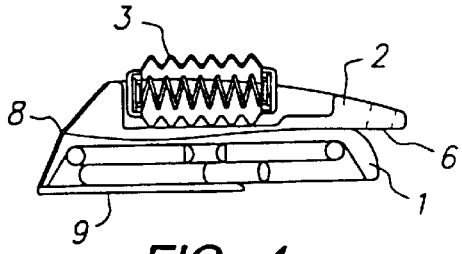
FIG. 4 is a side view of a presently preferred embodiment of the abdominal muscle exercising device of the present invention folded closed with adjustable resilient means, seat handle, and support legs retracted for transport or storage.
Figure 10:
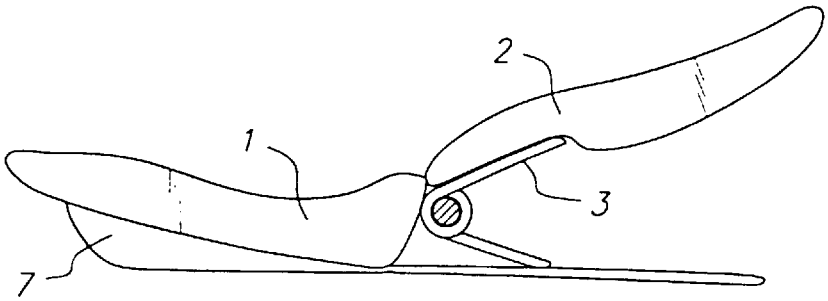
FIG. 10 is a side view of a second preferred embodiment of the abdominal muscle exercising device of the present invention with torsion spring adjustable resilient means fully extended for use.
Figure 11:
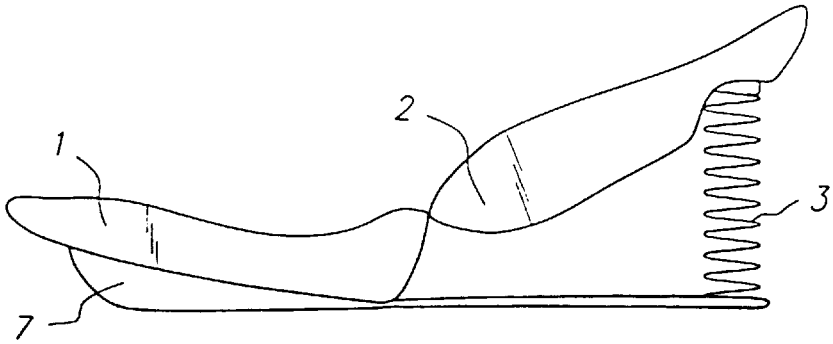
FIG. 11 is a side view of a second preferred embodiment of the abdominal muscle exercising device of the present invention with compression spring adjustable resilient means fully extended for use.
Figure 12:
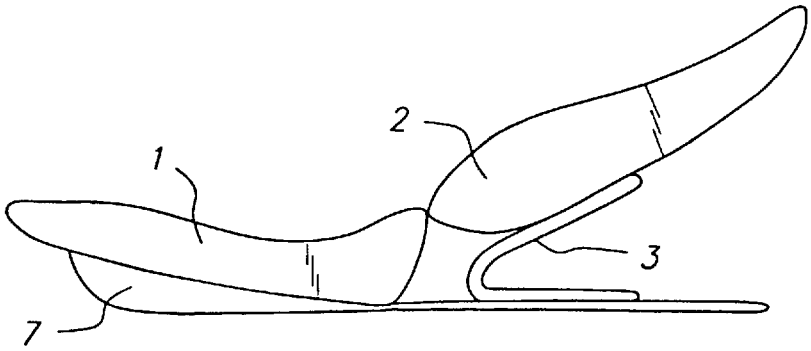
FIG. 12 is a side view of a second preferred embodiment of the abdominal muscle exercising device of the present invention with "C" shaped spring adjustable resilient means fully extended for use.

The back member 2 bottom side contains a retractable, adjustable resilient means 3 wherein a force applied against the back member 2 in a direction opposite the back member 2 is opposed by said adjustable resilient means 3. The adjustable resilient means 3 of the preferred embodiment shown in FIGS. 1–4, and 11 comprises at least one compression spring which is held in operable position by a stabilizing arm 9 as depicted in FIG. 2. The position of the resilient means 3 can be varied depending on the desired level of force from said means. The stabilizing arm 9 is pivotally attached to said seat member 1 bottom side and folds flat against said seat member 1 bottom side when the apparatus is not in use as depicted in FIG. 4. Other embodiments of said adjustable resilient means 3 comprises at least one torsion spring, FIG. 10, or at least one "C" spring, FIG. 12. Other possible adjustable resilient means include hydraulics, pneumatics, and the like.

The end of the back member 2 opposite the pivot 8 to the seat member 1 supplies a handle 6 for ease in transporting or storing the apparatus when not in use. As depicted in FIGS. 4–6, said handle may be unitarily constructed into said seat member 1.

The back member 2 top side is ergonomically constructed to support the exerciser's lumbar region.

Figure 8:
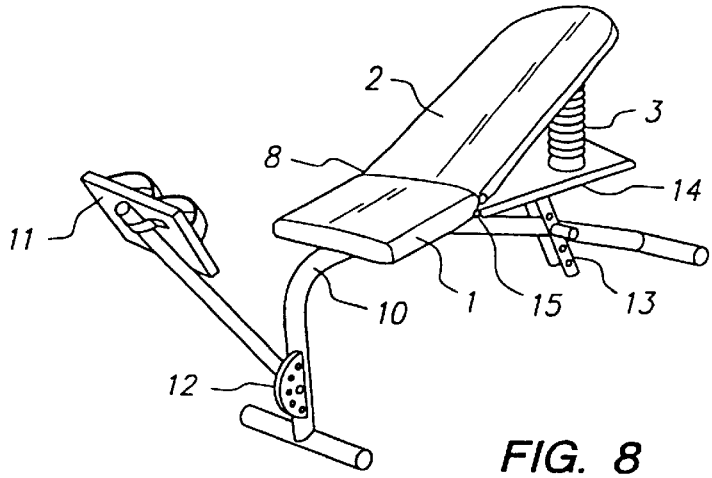
FIG. 8 is an isometric view of a second preferred embodiment of the abdominal muscle exercising device of the present invention with external support frame, adjustable foot rest, adjustable resilient means, and adjustable back member position.
Figure 9:
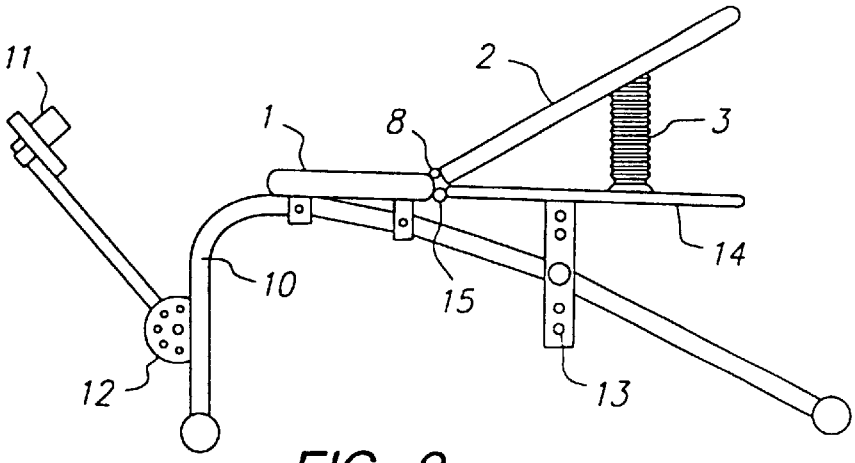
FIG. 9 is a side view of a second preferred embodiment of the abdominal muscle exercising device of the present invention folded with external support frame, adjustable foot rest, adjustable resilient means, and adjustable back member position.

In a second preferred embodiment of the present invention as depicted in FIGS. 8–9, a seat member. 1, a pivotally connected back support member 2, and a pivotally connected frame mount back member 14 are supported by an external frame assembly 10. Said frame assembly 10 provides the exerciser with a foot restraint 11 and a pivotal attachment 12 to angularly adjust said foot restraint 11 to the frame assembly 10. Said frame assembly 10 provides a pivot 13 to angularly adjust said frame mount back member 14. Said frame mount back member 14 is pivotally connected to said seat member, and operates independently of the pivotally connected back support member 2. As with the other embodiments of the present invention, the second preferred embodiment of the present invention absorbs the impact of the exerciser's eccentric exercise motion by said adjustable resilient means 3; the exerciser's concentric exercise motion is supported by said adjustable resilient means 3. The location of said resilient means is adjustable along the frame mount back member 14 and the back support member 2. In addition, the degree of the resilient means 3 is variable by adding or decreasing resilient means 3 components to the apparatus.

In the presently preferred embodiment of the abdominal muscle exercise apparatus invention the pivot 8 between the seat member 1 and back member 2 is a recessed polypropylene hinge, or similar device, affixed to the adjacent ends of the seat member 1 and back member 2 as depicted in FIGS. 1–5, and 7. In the second preferred embodiment of the abdominal muscle exercise apparatus invention depicted in FIG. 9 the pivot 8 between the seat member 1 and back support member 2 and the pivot 15 between the seat member 1 and frame mount back member 14 are piano hinges, or similar devices, affixed to the adjacent ends of the seat member 1 and back support member 2, and the seat member 1 and frame mount back member 14, respectively. This device offers maximum support for the exerciser's hips and back through the full range of abdominal exercises.

Figure 13:
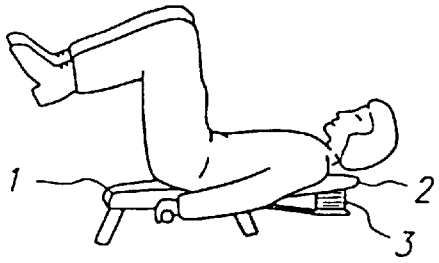
FIG. 13 is a side view of a presently preferred embodiment wherein the exerciser is sitting on the seat, hands on the seat handles, legs bent above the torso, and feet off the ground.
Figure 14:
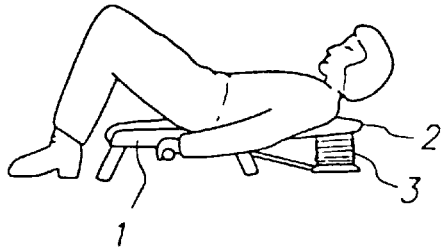
FIG. 14 is a side view of a presently preferred embodiment wherein the exerciser is& sitting on the seat, hands on the seat handles, legs bent above the torso, and feet on the ground.
Figure 15:
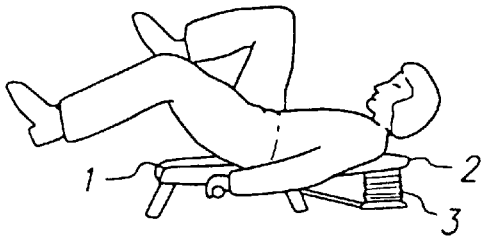
FIG. 15 is a side view of a presently preferred embodiment wherein the exerciser is sitting on the seat, hands on the seat handles, legs bent above the torso, and feet off the ground and rotating in a bicycling motion.
Figure 16:
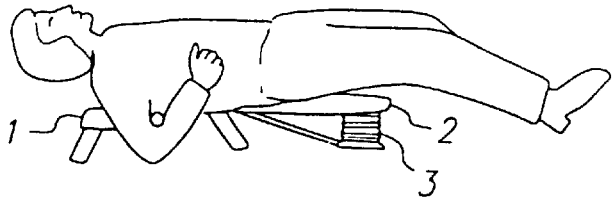
FIG. 16 is a side view of a presently preferred embodiment wherein the exerciser is sitting on the back member, arms locked under the seat handles, legs extended together outward along the back member.

The operation of the presently preferred embodiment of the abdominal muscle exercise apparatus invention wherein the exerciser elects to strengthen and condition the upper, lateral and oblique abdominal muscles is depicted in FIGS. 13–15. In this method of operation, the exerciser sits in the seat member 1 and reclines the back against the back member 2 with the legs bent and feet off the ground, FIG. 13, on the ground, FIG. 14, or rotated in a bicycling motion, FIG. 15. The adjustable resilient means 3 in the back member 2 helps the exerciser extend to the full range of backward motion while absorbing impact of the backward motion. The impact of the exerciser's eccentric exercise motion is adsorbed by said adjustable resilient means; the exerciser's concentric exercise motion is supported by said adjustable resilient means.

Figure 17:
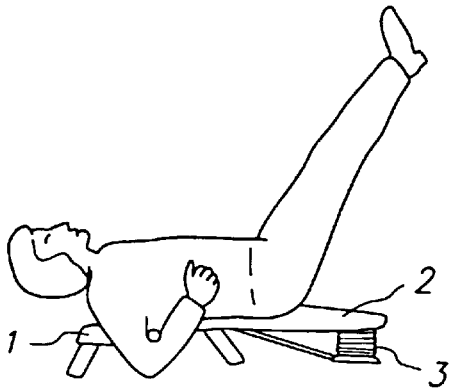
FIG. 17 is a side view of a presently preferred embodiment wherein the exerciser is sitting on the back member, arms locked under the seat handles, legs extended together above the torso.

The operation of the presently preferred embodiment of the abdominal muscle exercise apparatus invention wherein the exerciser elects to strengthen and condition the lower abdominal muscles is depicted in FIGS. 17–18. In this method of operation, the exerciser sits in the back member 2 and reclines the back against the seat member 1 with the legs extended and feet off the ground, FIG. 17, or raised together, FIG. 18. The adjustable resilient means 3 in the back member.2 assists in the exerciser's concentric motion to extend to the full range of extended raising leg motion FIG. 17 while absorbing impact of the exerciser's eccentric lowering leg motion FIG. 16.

With respect to the above description then, it is to be realized that the optimum dimensional relationships for the components of the invention, to include variations in size, materials, shape, form, function and manner of operation, assembly, manufacture, and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Additionally, since numerous modifications and changes will readily occur to those skilled in the art, it is not desired to limit the invention to the exact construction and operation shown and described, and further, all suitable modifications and equivalents may be resorted to, falling within the scope of the invention.

I claim:

1. An abdominal exercise machine comprising a horizontally extending seat mounted in a stationary position, a back support connected to the seat for pivotal movement between raised and lowered positions, and at least one resilient element connected to the back support for yieldably lifting the back support toward the raised position.

2. The exercise machine of claim 1 wherein the resilient element comprises a coil spring.

3. The exercise machine of claim 1 wherein the resilient element comprises a compression spring.

4. The exercise machine of claim 1 herein the resilient element comprises a torsion spring.

5. The exercise machine of claim 1 wherein the resilient element comprises a leaf spring.

6. An abdominal exercise machine, comprising a horizontally extending seat mounted in a stationary position, a back support connected to the seat for pivotal movement between a generally horizontal position and an inclined position, and means for yieldably urging the back support from the generally horizontal position toward the inclined position.

7. The exercise machine of claim 6 wherein the means for yieldably urging the back support from the generally horizontal position toward the inclined position comprises a coil spring.

8. The exercise machine of claim 6 wherein the means for yieldably urging the back support from the generally horizontal position toward the inclined position comprises a compression spring.

9. The exercise machine of claim 6 wherein the means for yieldably urging the back support from the generally horizontal position toward the inclined position comprises a torsion spring.

10. The exercise machine of claim 6 wherein the means for yieldably urging the back support from the generally horizontal position toward the inclined position comprises a leaf spring.

11. An abdominal exercise machine, comprising: a seat, a back support, means for pivotally connecting the back support to the seat for movement between open and closed positions, support legs pivotally connected to the seat for movement between a storage position in which the legs are folded flat against one side of the seat and a support position in which the legs extend downwardly from the seat for engagement with a supporting surface, and a spring pivotally connected to the back support for movement between a storage position in which the spring is folded flat against the back support and an operating position in which the spring urges the back support to pivot toward the seat from the open position.

12. The exercise machine of claim 11 wherein the spring is received in a recess in the back support in its storage position.

13. The exercise machine of claim 11 further including a pair of handles which are pivotally connected to the seat for movement between an extended position in which the handles extend laterally from opposite sides of the seat and a retracted position in which the handles are positioned beneath the seat.

14. The exercise machine of claim 11 further including a stabilizing arm which is pivotally connected to the seat for movement between a storage position in which the arm is folded flat against the seat and an operational position in which the arm engages the spring and holds the spring at a predetermined angle relative to the seat.

15. An abdominal exercise machine, comprising: a seat having a lower side adapted to rest on a supporting surface and an upper side adapted to receive the buttocks of a person using the machine, a back support hingedly connected to the seat for movement between a closed position in which the back support is folded over against the upper surface of the seat and an open position in which the back support extends from the seat for engagement with the back of a person using the machine, and a spring pivotally connected to the back support for movement between a storage position in which the spring is folded into a recess in the back support and an operating position in which the spring extends from the back support for engagement with the supporting surface to yieldably urge the back support to pivot in an upward direction.

16. The exercise machine of claim 15 wherein the seat and the back support have ergonomically contoured surfaces which interfit in mating relationship when the back support is in its closed position.

17. The exercise machine of claim 15 wherein the spring is a compression spring.

18. The exercise machine of claim 15 wherein the spring is a torsion spring.

19. The exercise machine of claim 15 wherein the spring is a leaf spring.

20. An abdominal exercise machine, comprising: a frame, a seat mounted in a stationary position on the frame, a backrest pivotally connected to the seat, a backrest support pivotally connected to the seat and extending beneath the backrest, means connected between the backrest support and the frame for holding the support in different angular positions relative to the seat, and means yieldably urging the backrest away from the support.

21. The exercise machine of claim 20 wherein the means urging the backrest away from the backrest support comprises a compression spring positioned between the backrest and the support.

22. The exercise machine of claim 20 further including a foot rest pivotally connected to the frame for receiving the feet of a person using the machine.

23. The exercise machine of claim 22 wherein the foot rest is pivotally connected to the frame for holding the feet in different positions.

* * * * *